US007341390B2

(12) United States Patent
Chang

(10) Patent No.: US 7,341,390 B2
(45) Date of Patent: Mar. 11, 2008

(54) LOOSE-LEAF BINDER

(76) Inventor: Sun L Chang, 12F-2, No. 3, Sec. 2, Huamei W. St., Hsitun Dist., Taichung (TW)

( * ) Notice: Subject to any disclaimer, the term of this patent is extended or adjusted under 35 U.S.C. 154(b) by 631 days.

(21) Appl. No.: 10/838,192

(22) Filed: May 5, 2004

(65) Prior Publication Data

US 2005/0249543 A1 Nov. 10, 2005

(51) Int. Cl.
*B42F 3/00* (2006.01)

(52) U.S. Cl. ..... 402/60; 402/5; 24/614

(58) Field of Classification Search ..... 281/15.1, 281/21.1, 29, 80 R; 402/4, 60, 73; 24/614, 24/615, 616, 625, 662

See application file for complete search history.

(56) References Cited

U.S. PATENT DOCUMENTS

D255,903 S * 7/1980 Cable ..... D15/139
4,306,736 A * 12/1981 Cournover et al. ..... 281/43
4,445,799 A * 5/1984 Wright et al. ..... 402/4
4,453,851 A * 6/1984 Purcocks ..... 402/15
4,524,991 A * 6/1985 Thomas ..... 281/20
4,569,613 A * 2/1986 Thomas ..... 402/80 R
4,679,282 A * 7/1987 Feng ..... 24/614
4,773,787 A * 9/1988 Chang ..... 402/60
5,009,537 A * 4/1991 Stengel ..... 402/21
5,037,229 A * 8/1991 Stengel ..... 402/20
5,590,444 A * 1/1997 Krauss ..... 24/625
5,672,022 A * 9/1997 Lin ..... 402/73
6,684,466 B2 * 2/2004 Nishida et al. ..... 24/615

FOREIGN PATENT DOCUMENTS

CH 431454 * 8/1967
GB 2422577 A * 8/2006

* cited by examiner

*Primary Examiner*—Dana Ross
(74) *Attorney, Agent, or Firm*—Troxell Law Office, PLLC

(57) ABSTRACT

A loose-leaf binder has a back, a binder made of a flexible material and attached to the back and two end plugs mounted respectively in ends of the back. The back has two tracks, two side slots and a middle slot. The binder has multiple open rings having two ends. Each plug has two side tines and a middle tine. A notebook with the loose-leaf papers can be easily attached to or detached from the loose-leaf binder by attaching or detaching the open rings of the binder to punched holes in the notebook simultaneously.

1 Claim, 5 Drawing Sheets

LOOSE-LEAF BINDER

BACKGROUND OF THE INVENTION

1. Field of the Invention

The present invention relates to a binder, and more particularly to a binder for loose-leaf paper.

2. Description of Related Art

With reference to FIG. 5, a conventional loose-leaf binder in accordance with the prior art is a binder (70) that is a flexible spiral coil. The binder (70) has two ends (not numbered) and is attached to a notebook (60) having loose-leaf paper (not numbered) through multiple punched holes (61). The binder (70) is attached to the notebook (60) by passing one end of the binder (70) sequentially through all the punched holes (61) in the loose-papers. However, one loose-leaf sheet of paper cannot be removed from the binder (70) without tearing the loose-leaf sheet of paper unless the binder (70) is completely removed from all the through holes (61) in the notebook (60) first. Therefore, inserting and removing sheets of paper from the binder is time consuming.

To overcome the shortcomings, the present invention provides an improved loose-leaf binder to mitigate or obviate the aforementioned problems.

SUMMARY OF THE INVENTION

The main objective of the invention is to provide a loose-leaf binder that allows sheets of loose-leaf paper to be quickly and easily inserted into or removed from the binder by hand.

A loose-leaf binder in accordance with the present invention comprises a back, a binder and two end plugs.

The back has two ends, two longitudinal side slots and a middle slot. The binder has multiple open rings mounted inside the side slots in the back. The end plugs are mounted respectively in the ends of the back.

Other objectives, advantages and novel features of the invention will become more apparent from the following detailed description when taken in conjunction with the accompanying drawings.

DETAILED DESCRIPTION OF PREFERRED EMBODIMENT

Figure 1:
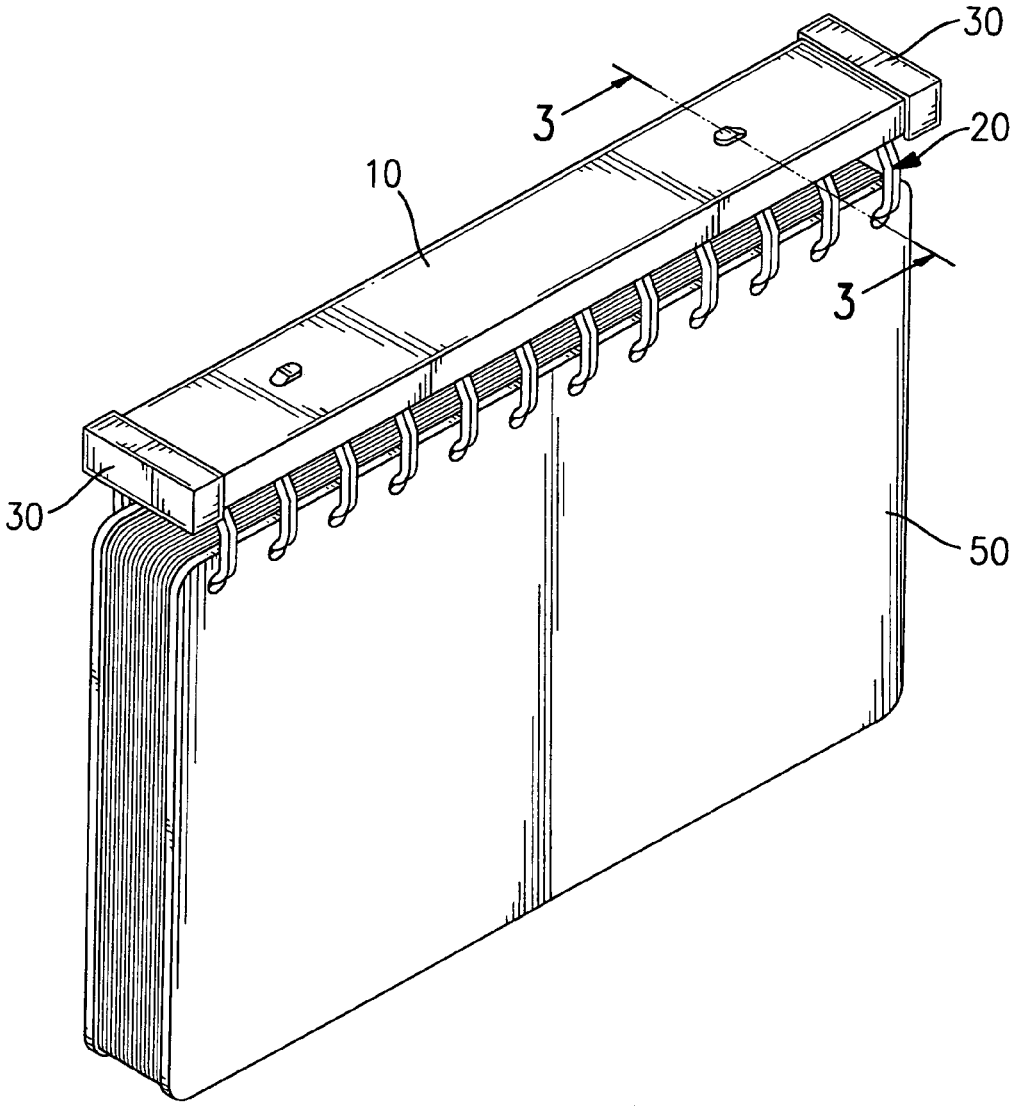
FIG. 1 is a perspective view of a loose-leaf binder in accordance with the present invention.
Figure 2:
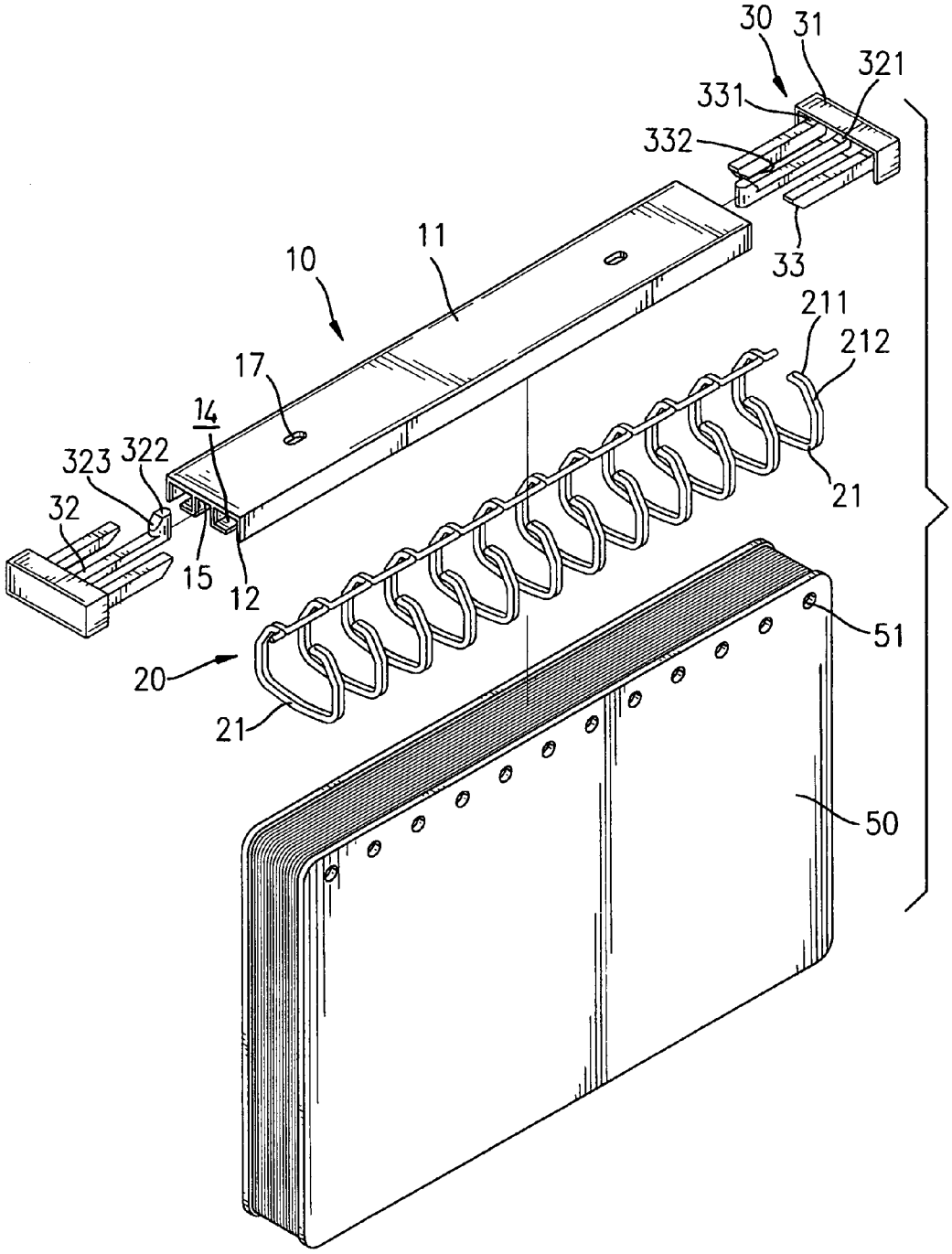
FIG. 2 is an exploded perspective view of the loose-leaf binder in FIG. 1.
Figure 3:
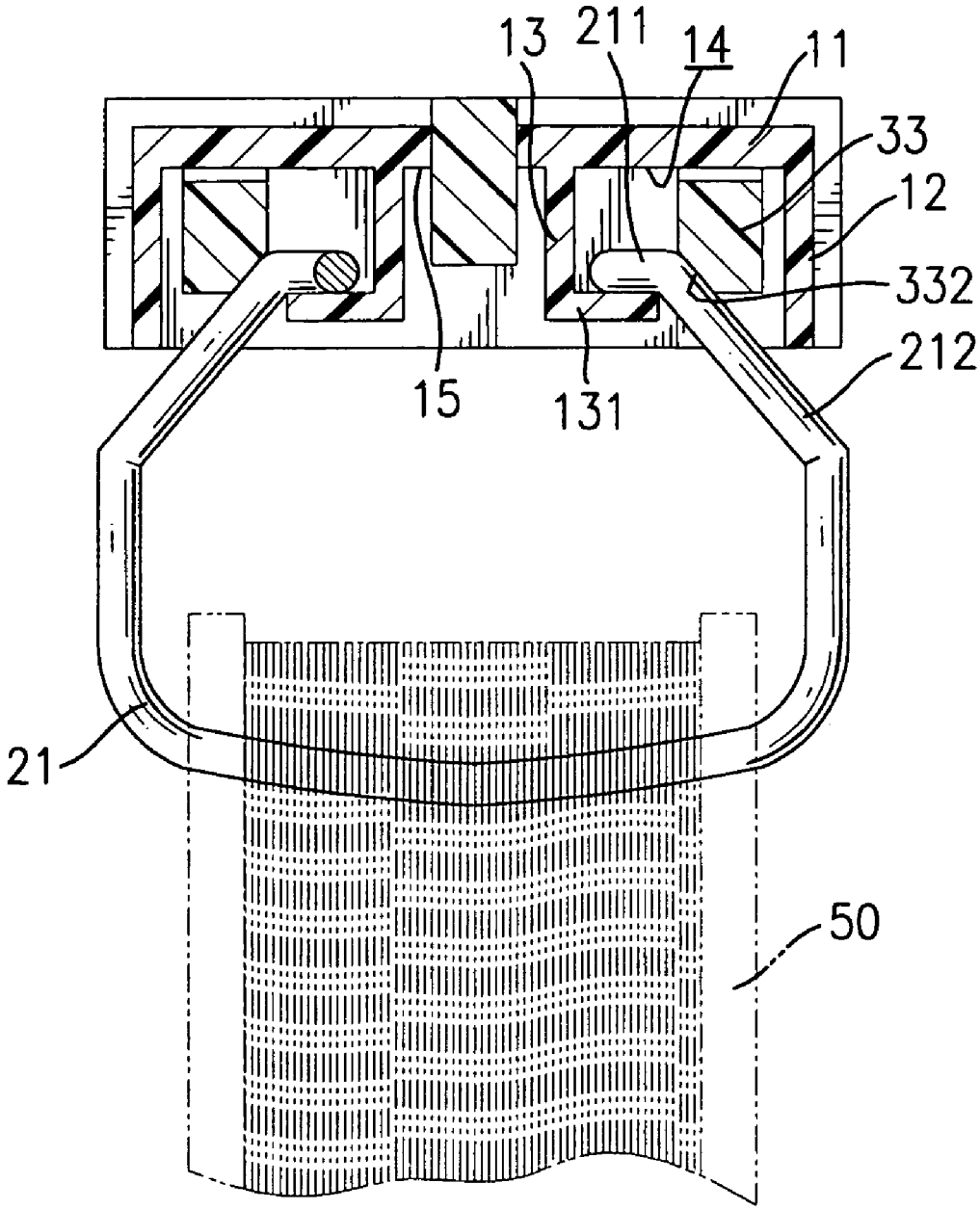
FIG. 3 is an enlarged cross-sectional end view of the loose-leaf binder along line 3-3 in FIG. 1.
Figure 4:
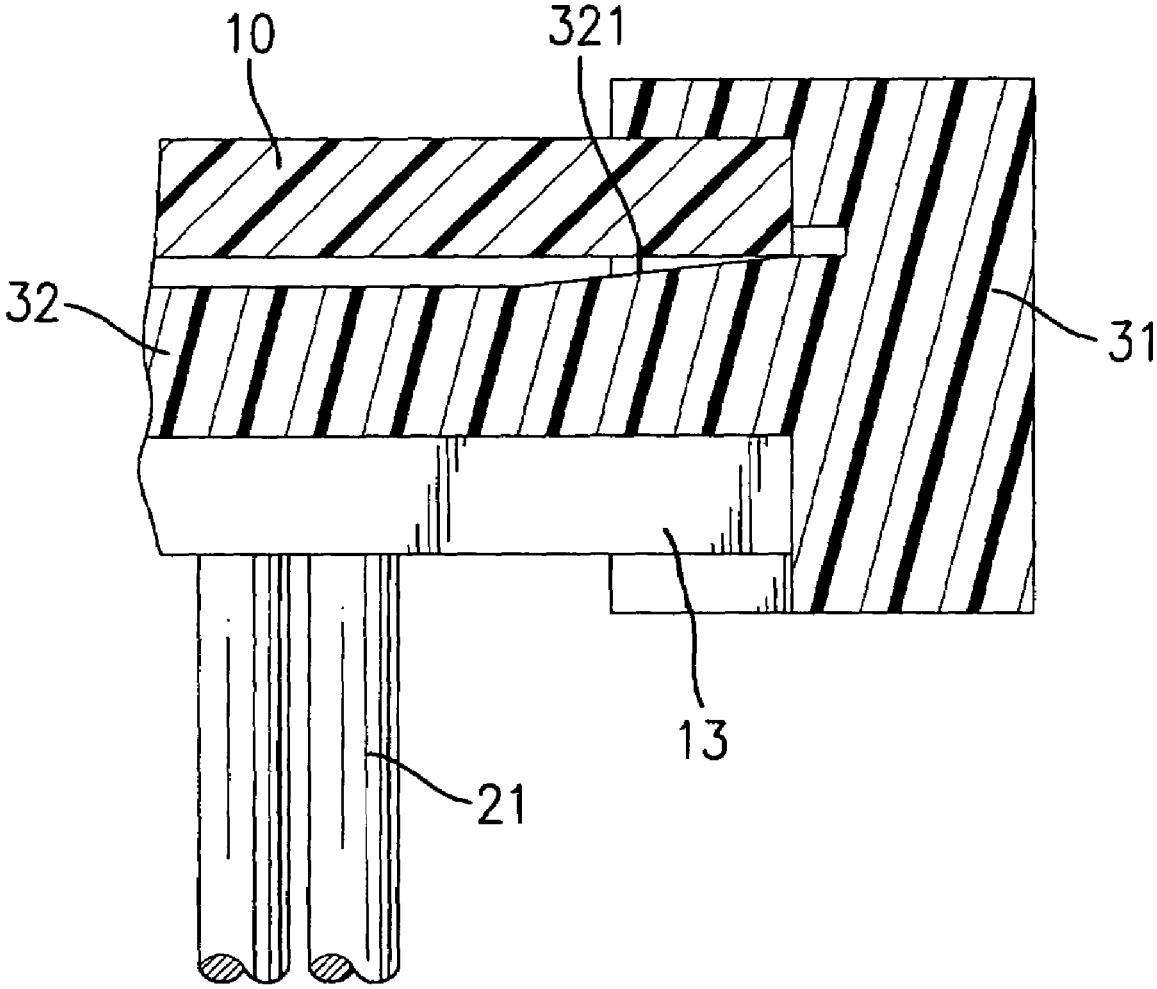
FIG. 4 is an enlarged cross-sectional front view of the loose-leaf binder in FIG. 1.
Figure 5:
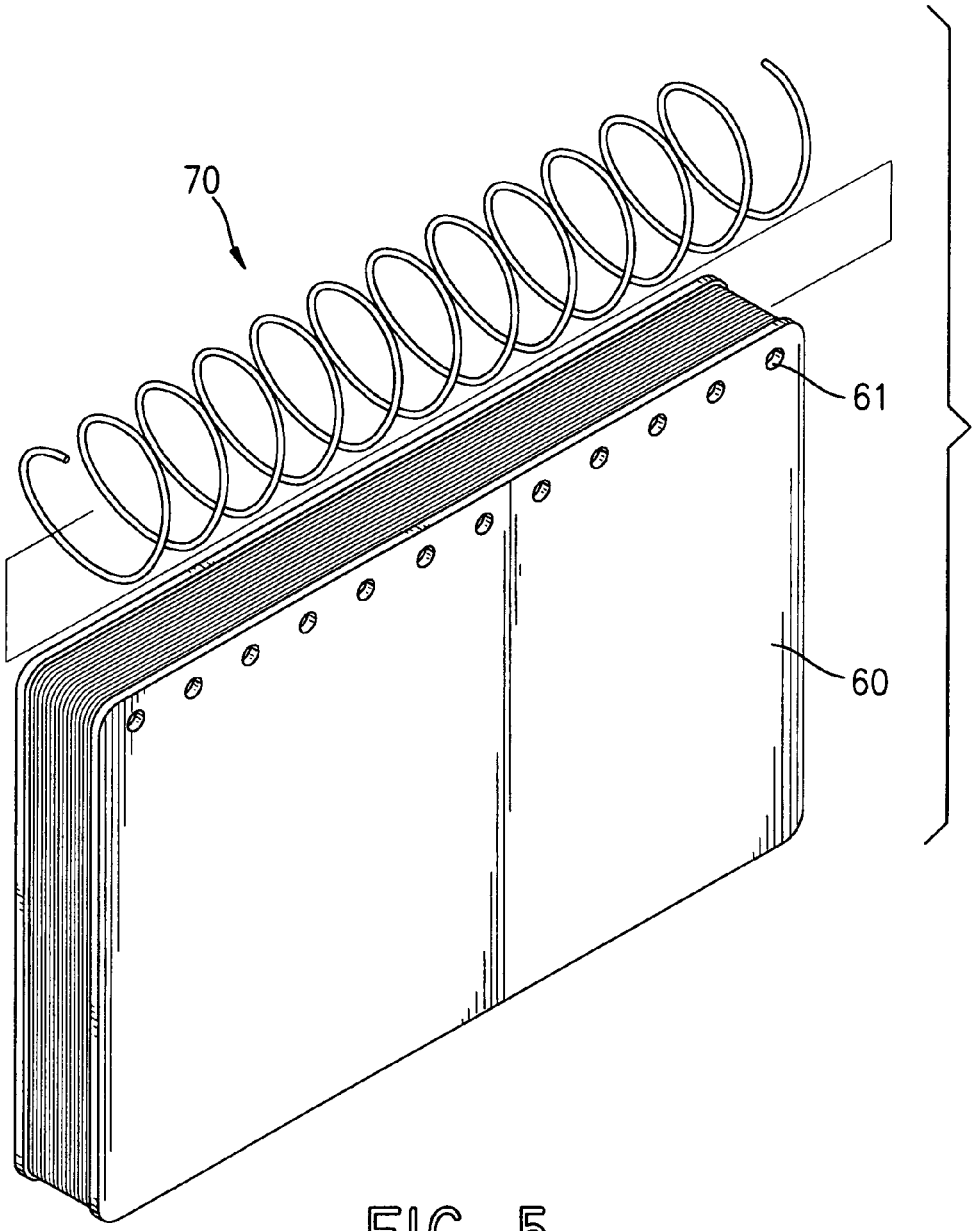
FIG. 5 PRIOR ART
FIG. 5 is an exploded perspective view of a conventional loose-leaf binder in accordance with the prior art.

With reference to FIGS. 1, 2, 3 and 4, a loose-leaf binder comprises a back (10), a binder (20) and two end plugs (30).

The back (10) has a spine (11), two skirts (12), two tracks (13), two side slots (14), a middle slot (15) and two ends (not numbered). The spine (11) has a top surface (not numbered), a bottom surface (not numbered), two edges (not numbered) and two through holes (17). The two skirts (12) are defined on the bottom surface of the spine (11) respectively at the edges. The two tracks (13) are defined between the skirts (12) and perpendicularly protrude from the spine (11). Two longitudinal lips (131) are defined respectively on and perpendicularly protrude from the tracks (13) and parallel to the spine (11). The two side slots (14) are defined respectively between the corresponding skirts (12) and tracks (13). The middle slot (15) is defined longitudinally between the two tracks (13). The through holes (17) are defined near the ends of the back (10) and communicate with the middle slot (15).

The binder (20) is made of flexible material, is attached to the back (10) and has multiple open rings (21). Each open ring (21) has two ends (not numbered), two level sections (211), and two inclined sections (212). The open ring is defined in a curved shape with at lest one angle. The two inclined sections (212) are defined adjacent respectively to the level sections (211) on each open ring (21). The two level sections (211) are defined respectively on the ends of each open ring (21) and are parallel to the inclined sections (212). Each level section (211) hooks on one of the inclined sections (212). Each level section (211) is defined on one of the inclined sections (212) with an angle (213) to prevent the binder (20) from slipping off easily relative from the longitudinal lip (131). Furthermore, the longitudinal lip (131) is defined parallel to the back (10) and is able to effectively resist from pulling off the binder (20) from the back (10) by an external force.

The two end plugs (30) are mounted respectively in the ends of the back (10). Each end plug (30) has a plug cover (31), a middle tine (32) and two side tines (33). The plug covers (31) are attached respectively to the ends of the back (10).

The middle tine (32) extends from the plug cover (31) and has a top (not numbered), a distal end (not numbered), a proximal end (not numbered), a middle inclined compression surface (321) and a latch (322). The proximal end is formed integrally with the plug cover (31). The middle inclined compression surface (321) is defined on the top of the middle tine (32) at the proximal end. The latch (322) is defined at the distal end of the middle tine (32) and has an inclined release surface (323) sloping down toward the corresponding plug cover (31).

The two side tines (33) extend from each plug cover (31) on opposite sides of the middle tine (32). Each side tine (33) has a top (not numbered), a bottom (not numbered), a distal end (not numbered), a proximal end (not numbered), a side inclined compression surface (331) and a sloped groove (332). The proximal end is formed integrally with the plug cover (31). The side inclined compression surface (331) is defined on the top of the side tine (33) at the proximal end. The sloped groove (332) is defined longitudinally in the bottom of the side tine between the distal end and proximal end of each side tine (33) and faces the middle tine (32).

When attaching a notebook (50) with loose-leaf papers (not numbered) having multiple punched holes (51) to the loose-leaf binder, the open rings (21) of the binder (20) pass through all the punched holes (51) simultaneously. Then the level sections (211) of the open rings (21) slide into the corresponding side slots (14) from the end of the back (10) and are hooked by the longitudinal lips (131) of the tracks (13) to prevent the level sections (211) from coming off.

When each end plug (30) is inserted into the end of the spine (11), the middle tine (32) and side tines (33) of each end plug (30) are inserted respectively into the middle slot (15) and side slots (14). The side inclined compression surfaces (331) and the middle inclined compression surface (321) are pressed tightly into the end of the spine (11) to hold the end plug (30) in the spine (11). The sloped grooves (332)

in the side tines (33) press respectively against the inclined sections (212) of the binder (20) to keep the ends of the open ring (21) from moving transversely inside the side slots (14) and disengaging from the longitudinal lips (131).

When the plug cover (31) abuts the end of the spine (11), the latch (322) of each end plug (30) engages the corresponding through hole (17) to positively hold the end plug (30) in the spine (11).

When detaching or attaching the loose-leaf binder to loose-leafpapers or a notebook (50), the latch (322) is pushed into the corresponding through hole (17), and the end plug (30) is pulled out of the spine (11). The inclined release surface (323) on each latch (322) allows the latches (322) to be pulled out of the through holes (17) without having to push the latches (322) completely through the through holes (17). Therefore, the end plug (30) may be detached easily from the back (10). Consequently, the back (10) and the notebook (50) can be separated quickly.

The back (10) can be easily slid off or onto the binder (20). Furthermore, the end plug (30) with the latch (322) having the inclined release surface (323) may be separated easily from the end of the spine (11) by hand. Therefore, the loose-leaf papers or the notebook can be detached from or attached to the loose-leaf binder quickly and save time.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A loose-leaf binder comprising:

a) a back having:

i) two ends;

ii) a spine having a top surface, a bottom surface, two edges and two through holes defined near the ends of the back;

iii) two skirts defined respectively on the bottom surface respectively at the edges of the spine;

iv) two tracks defined between the two skirts on the bottom surface of the spine, wherein two longitudinal lips are defined respectively on the tracks and parallel to the spine;

v) two side slots defined respectively between the corresponding side skirts and tracks; and vi) a middle slot defined longitudinally between the tracks;

b) a binder made of a flexible material, attached to the back, and having multiple open rings being detachably attached to the back and defined in a curved shape with at least one angle, each open ring of the multiple open rings having:

i) two ends;

ii) two inclined sections being defined adjacent respectively to two level sections of the open rings; and iii) the two level sections are defined respectively on the ends of the open rings, are parallel to the inclined sections and hooking on one of the inclined sections; and c) two end plugs mounted respectively in the ends of the back, each of the two end plugs having:

i) a plug cover attached to one of the ends of the back;

ii) a middle tine extending from the plug cover and having:

(1) a top;

(2) a distal end;

(3) a proximal end formed integrally with the plug cover;

(4) a middle inclined compression surface is defined on the top of the middle tine at the proximal end; and (5) a latch defined at the distal end and having an inclined release surface sloping down toward the corresponding plug cover; and iii) two side tines extending from the plug cover on opposite sides of the middle tine, each of the two side tines having:

(1) a top;

(2) a bottom;

(3) a distal end;

(4) a proximal end formed integrally with the plug cover;

(5) a side inclined compression surface defined on the top of the side tine at the proximal end; and (6) a sloped groove defined longitudinally in the bottom of the side tine between the distal end, proximal end of the side tine and facing the middle tine and pressing the inclined section of at least one of the open rings on the binder.

* * * * *